US005711720A

United States Patent [19]

Janes et al.

[11] Patent Number: 5,711,720

[45] Date of Patent: Jan. 27, 1998

[54] DECORATIVE HANDLE FOR IMPLEMENTS SUCH AS SPORTS RACQUETS

[75] Inventors: Richard Janes, Burlington Township, N.J.; Stephen J. Davis, Washington Crossing, Pa.

[73] Assignee: Prince Sports Group, Inc., Bordentown, N.J.

[21] Appl. No.: 639,884

[22] Filed: Apr. 19, 1996

[51] Int. Cl.[6] ..... A63B 49/08; A63B 53/14

[52] U.S. Cl. ..... 473/300; 473/549

[58] Field of Search ..... 273/73 R, 73 J, 273/75; 473/300, 301, 302, 303, 549

[56] References Cited

U.S. PATENT DOCUMENTS

| | | | |
|---|---|---|---|
| 1,863,079 | 6/1932 | Wright | 473/301 X |
| 4,185,375 | 1/1980 | Brown | 273/75 X |
| 4,819,939 | 4/1989 | Kobayashi | 473/300 X |
| 5,419,031 | 5/1995 | McLendon | 273/75 X |
| 5,435,549 | 7/1995 | Chen | 273/75 |
| 5,439,217 | 8/1995 | Ganger | 273/75 |
| 5,482,270 | 1/1996 | Smith | 273/75 X |
| 5,491,015 | 2/1996 | Reeves et al. | 273/75 X |
| 5,524,885 | 6/1996 | Heo | 273/75 X |

FOREIGN PATENT DOCUMENTS

| | | | |
|---|---|---|---|
| 4039534 | 6/1992 | Germany | 273/75 |
| 9303799 | 3/1993 | WIPO | 273/75 |

*Primary Examiner*—William E. Stoll
*Attorney, Agent, or Firm*—White & Case

[57] ABSTRACT

A handle for a sports implement comprises a handle portion having an outer surface containing a decorative design. A grip sleeve made of a relatively thin, translucent, and preferably transparent, elastomeric material, is sized to cover the handle portion and be in frictional contact therewith, such that said decorative design shows clearly through. In the case of sports racquets, the handle portion may be formed either by a pallet on the racquet shaft, or by a molded-in handle.

24 Claims, 4 Drawing Sheets

DECORATIVE HANDLE FOR IMPLEMENTS SUCH AS SPORTS RACQUETS

FIELD OF INVENTION

The present invention relates to handles for sports implements, and most preferably relates to handles for sports racquets such as a tennis, squash, racquetball, or badminton racquet. Preferred embodiments of the invention will be described with reference to racquetball and tennis racquets.

BACKGROUND OF THE INVENTION

Sports racquet frames include a head, which supports strings for hitting a ball or shuttlecock, and a handle which is gripped by the player. In the past, racquet handles were generally made of an octagonal shaped pallet which was mounted on the racquet shaft and wrapped with a textured leather or synthetic grip. More recently, molded-in handles have been introduced, in which the shaft portion of the frame is molded directly into the desired octagonal outer shape, and wrapped by a grip. In either case, the grip may be covered with a replaceable thin overwrap or sheath, which either is wrapped over the grip or which slides over it.

It is possible to form the grip outer surface with a decorative design, or for the manufacturer to place its name or logo on the outer surface. However, the degree of decorative effect is limited.

SUMMARY OF THE INVENTION

The present invention is a decorative handle for a sports implement such as a racquet. The implement includes a shaft containing an outer surface portion that is intended to be gripped. The portion of the shaft that is intended to be gripped can be formed either using a handle pallet on the shaft, such as a slide-on, cushion pallet as disclosed in commonly owned U.S. Pat. No. 5,034,082, or a foamed-in-place pallet, or alternatively the portion intended to be gripped can be a portion of the shaft itself, e.g., in the case of sports racquets, a molded-in handle.

Preferably, the portion to be gripped, whether it be the shaft or a pallet on the shaft, has an outer surface containing a decorative design. In the case of an implement containing a pallet, the decorative design may be formed by providing a plurality of holes, slots, or other indentations in the outer surface of the pallet. Alternatively, the shaft outer surface can be provided with a decorative design in any suitable manner, such as by molding, painting, etc.

An overgrip sleeve made of a relatively thin, translucent, elastomeric material, covers the outer surface, and is in frictional contact therewith. As used in the present application, the term "translucent" refers to materials that are transparent (i.e., clear) or tinted, but also includes materials which diffuse light slightly as it passes through, provided that the underlying design remains at least substantially visible through the material. Thus, in the present invention, the decorative design is visible through the overgrip and is spatially distanced from the outer surface of the overgrip.

When the overgrip sleeve is used with a handle pallet, preferably the pallet and overgrip sleeve are made of materials having sufficient frictional affinity toward one another that said grip could, if desired, be held on said pallet without any adhesive, although as described below a clear solvent, which acts as an adhesive, is preferably used. Most preferably, the sleeve and pallet are made of Kraton rubber.

In the case where the overgrip sleeve is disposed on the shaft, the sleeve is preferably held in place with an adhesive, such as a clear solvent, that does not affect transparency.

In a preferred embodiment, the grip is slipped over the handle pallet or the shaft with the aid of a solvent such as mineral spirits or naphtha, which is applied to the pallet or shaft outer surface or the overgrip inner surface. The solvent evaporates after installation, leaving both surfaces sticky relative to one another and thereby acts as a clear adhesive.

To create the most striking decorative effect, the pallet outer surface is one or several light colors, e.g., a. tinted pastel such as lime green, pink or yellow. The inner surface of the overgrip, which is in contact with the pallet outer surface, is preferably smooth and of uniform thickness.

The pallet is preferably formed of a cushion material, and has a generally octagonal outer surface. The unstretched sleeve grip has a wall thickness in the range of 1.2 to 2.0 mm, In an unstretched condition, the sleeve is slightly smaller than the pallet or, in the case where applied directly over the shaft, slightly smaller than the handle portion of the shaft.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
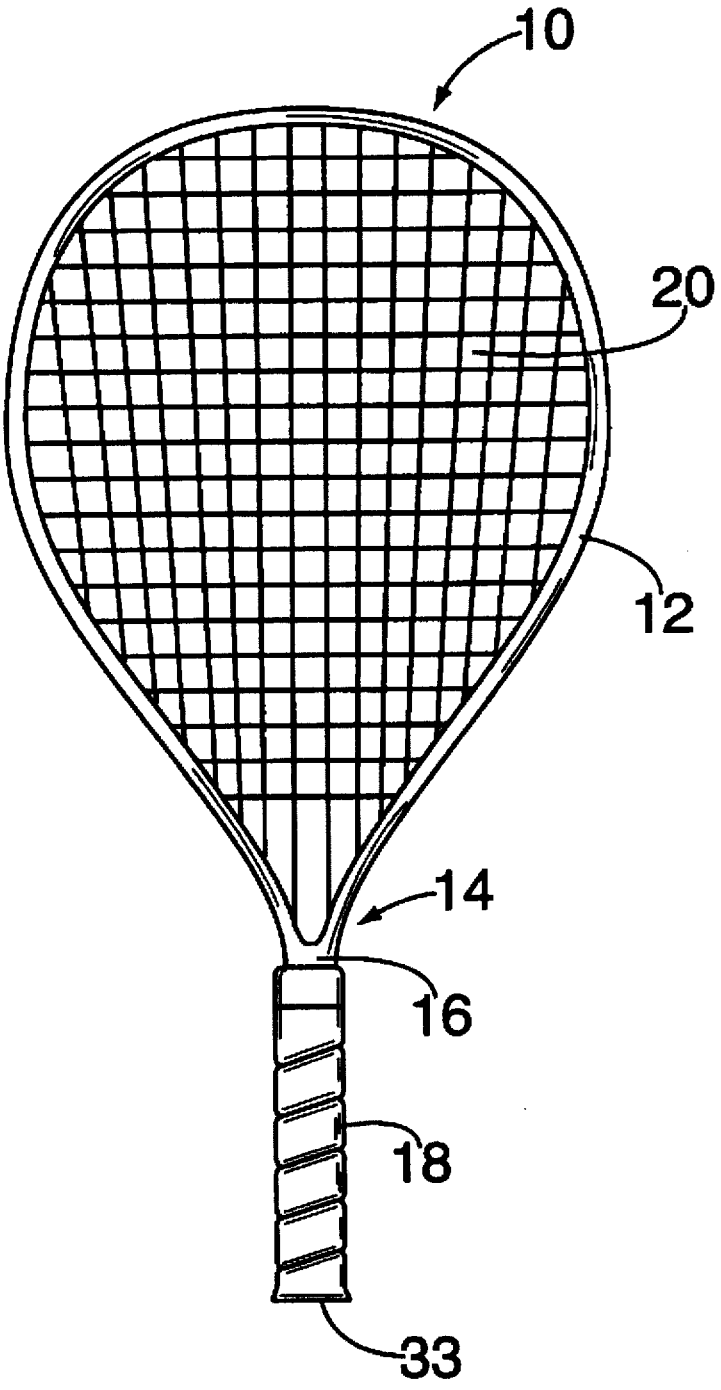
FIG. 1 is a front view of a racquetball racquet in which the invention may be utilized.
Figure 7:
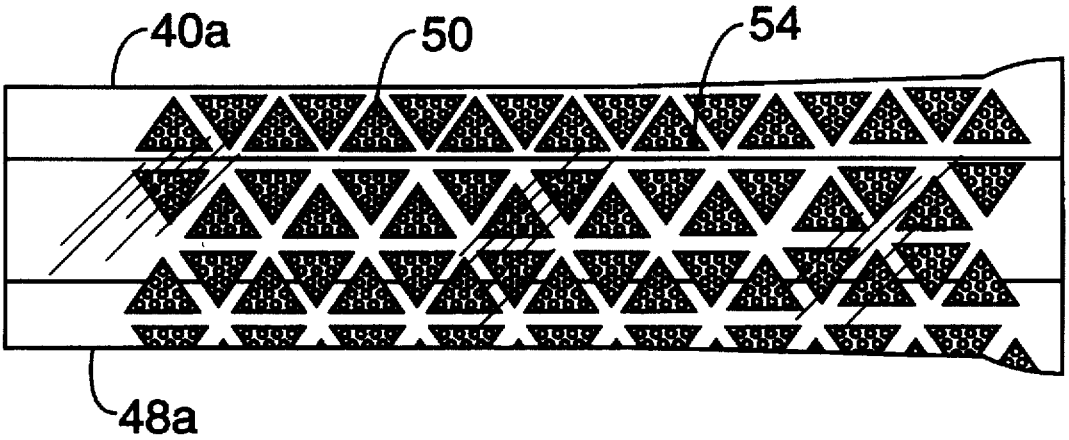
FIG. 7 is a top view of an alternative embodiment of an overgrip sleeve.

FIG. 1 shows a racquetball racquet 10 having a frame forming a head portion 12, a throat region 14, and a shaft 16 carrying handle 18. A plurality of interwoven strings 20 are supported by the head portion 12 in a conventional manner. The handle 18 is formed from a hollow cushion pallet 22, an example of which is shown in FIGS. 2–3, and a hollow overgrip sleeve 24, examples of which are shown in FIGS. 4 and 7.

Figure 2:
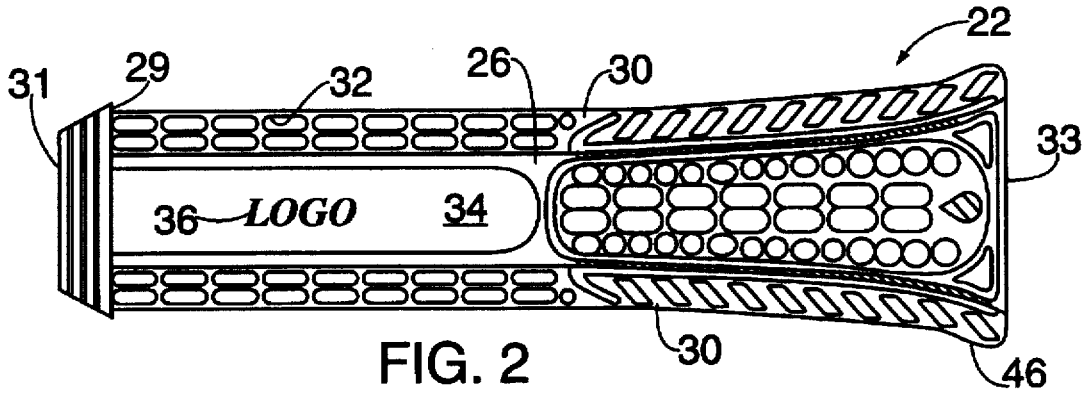
FIGS. 2 and 3 are top and side views, respectively, of a handle pallet that may be used on the racquet of FIG. 1.
Figure 3:
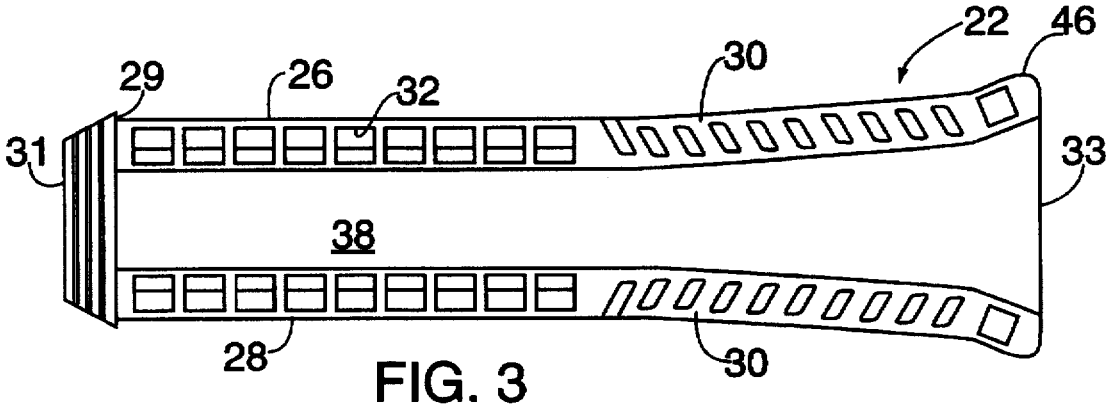
Figure 4:
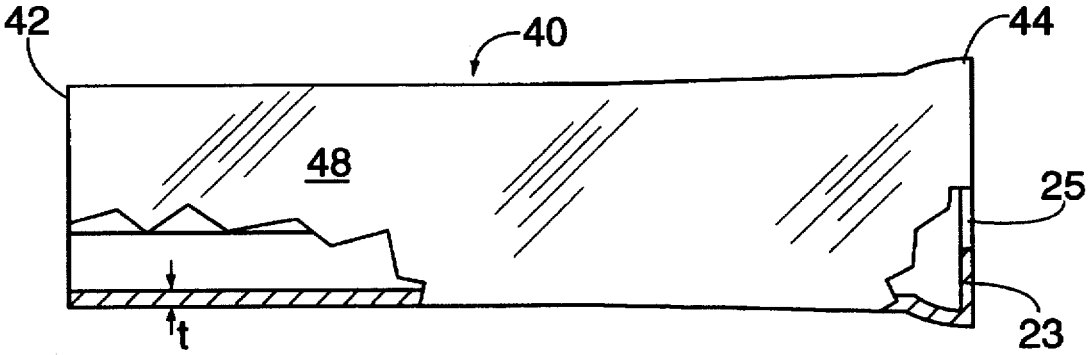
FIG. 4 is a top view of an overgrip sleeve for use with the pallet of FIGS. 2–3.

Referring to FIGS. 2–3, the pallet 22 includes a plurality of exterior surfaces which are arranged in a conventional, generally octagonal manner. The pallet is made of an elastomeric thermoplastic material, such as Kraton G2705, shore A 60, which is a thermoplastic rubber sold by the Shell Oil Company.

Figure 6:
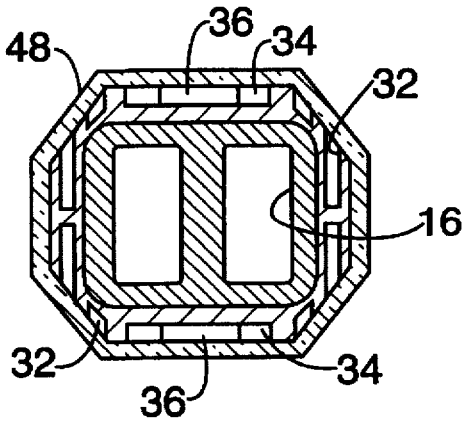
FIG. 6 is a cross-sectional view of the pallet, sleeve, and racquet shaft, taken through lines 6—6 of FIG. 5.

In the exemplary embodiment, the top 26, bottom 28, and diagonal 30 surfaces are provided with a varying pattern of holes and slots, of various shapes and sizes, to create a decorative effect. Also, a recessed flat 34 is formed in the upper and lower surfaces 26, 28, which can carry a product name or logo 36. As shown in FIG. 6, preferably the name or logo 36 is provided in raised letters or other raised portion, so as to be flush with the top and bottom surfaces 26, 28 of the pallet 22.

As disclosed in Davis et at. U.S. patent application Ser. No. 07/373,331, when a cushion pallet is utilized, it is desirable, for functional reasons, to provide holes in some, but not all, of the pallet surfaces, in order to increase softness in selected areas. Thus, it is preferable, where the decorative effect is created by a pattern of holes, slots or other indentations to the rubber pallet, to confine the holes etc. to the top surface 26, bottom surface 28, and diagonal surfaces 30 of the pallet. Preferably, the side surfaces 38 are not provided with holes, so that the side surfaces 38 are firmer than the other surfaces. The hole pattern shown in the Davis et at. application may be employed in the present invention, but a more varied design or pattern, such as that shown in FIGS. 2–3, is preferred to provide a more striking visual effect.

As also shown in FIGS. 2–3, the pallet 22 has a lip 29 at its forward end 31, which is the end opposite to the butt end 33.

The overgrip tube or sleeve 40 is made of a translucent material (as defined above). In a preferred embodiment, the overgrip sleeve 40 is formed of a transparent elastomeric material, e.g. Kraton Vulcatane (Shore A 52 hardness), and has a relatively thin wall thickness, e.g., a wall thickness "t" in the range of 1.2 to 2.0 mm unstretehed. The overgrip material is preferably completely transparent in order that the underlying design is fully visible, but if desired it may be slightly tinted or may slightly diffuse light.

The overgrip sleeve is open at its forward end 42, and where a material such as Kraton is used that assumes a defined shape, the sleeve 22 may be shaped so as to have an inner surface that conforms to the outer surface of the pallet 22. However, because the sleeve is thin and flexible, it will when stretched over the pallet assume the shape of the underlying surface. Therefore, it is not necessary to pre-shape the sleeve, and the sleeve can be circular in cross-section. Preferably, the sleeve wall partially encloses the butt end 23, as shown in FIG. 4, but leaves an opening 25 so as not to close off the butt end entirely. The purpose of opening 25 is to allow a wrist cord, normally used in racquetball racquets, to pass through to the interior of the handle, where it is secured.

Referring to FIG. 6, the pallet has an interior that fits snugly about the racquet shaft 16. Preferably, the pallet is mounted by sliding it onto the racquet shaft 16, where it is thereafter retained by adhesive, as disclosed in commonly owned U.S. Pat. No. 5,034,082 and Davis et al U.S. patent application Ser. No. 07/373,331.

The translucent overgrip sleeve 40 is then mounted over the pallet 22, so that the forward end 42 of the sleeve 40 is flush-with the lip 29 of the pallet 22, and such that the butt end 44 of the sleeve 40 covers the flared butt end 46 of the pallet 22. Preferably, a solvent such as mineral spirits or naphtha is applied to one or both of the contacting surfaces, to help slide on the sleeve 40. When dried, the solvent acts as an adherent between the sleeve and pallet.

The overgrip sleeve preferably has an internal dimension which is slightly smaller than the outer surface of the pallet 22, and therefore needs to be stretched slightly to fit over the pallet. 22. Preferably, where materials other than Kraton are used, the overgrip sleeve 40 and the pallet 22 are made of materials that have a relatively high frictional affinity toward one another, i.e., comparable to rubber-against-rubber. In this manner, when the overgrip sleeve 40 is mounted on the pallet 22, it is retained by friction.

Figure 5:
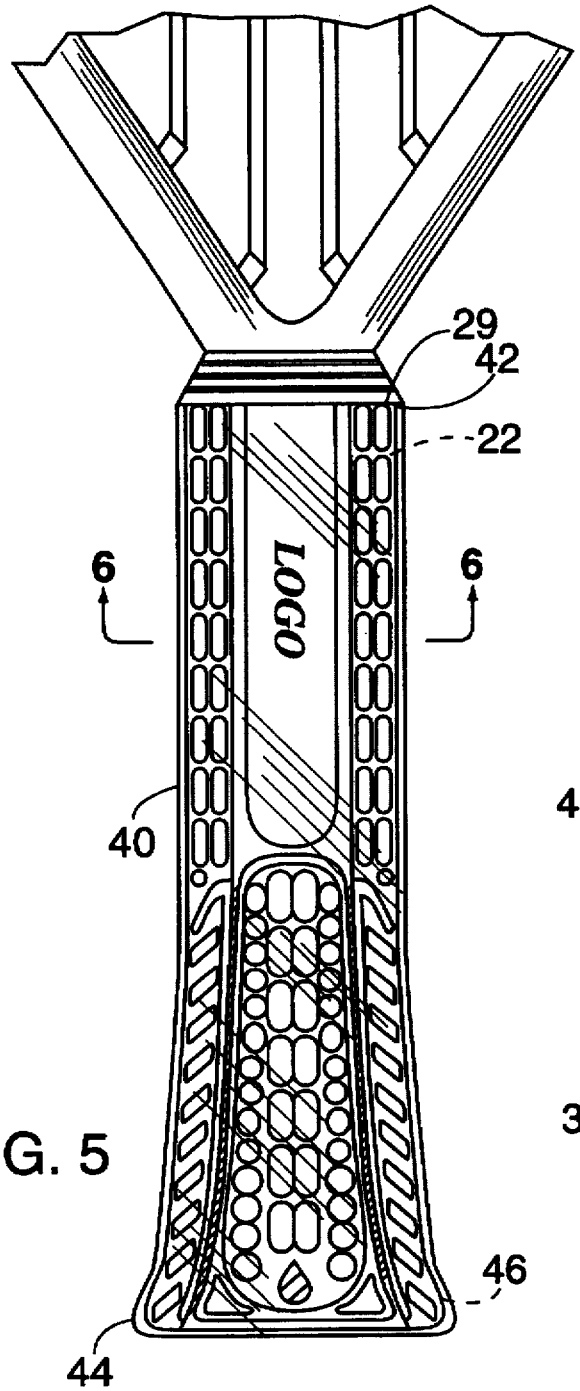
FIG. 5 is a front view of the pallet and sleeve as mounted on a racquetball racquet.

As shown in FIGS. 5–6, the overgrip sleeve 40 will cover the holes 32 and recesses 36. As noted above, preferably the recesses are partially filled by the raised logo or design, whose upper surface is flush against the inner surface of the overgrip sleeve 40, to help support the sleeve 40.

In the preferred embodiment, the inner surface of the overgrip sleeve 40, and the outer surface 48 of the overgrip sleeve 40, are smooth. The outer surface 48 of the overgrip sleeve 40 may alternatively be textured in some manner, such as shown in FIG. 7. In the FIG. 7 embodiment, the outer surface **48*a* is provided with a pattern of raised, alternately oppositely facing, triangular areas 50, which contain plural small indentations 54**. The contoured gripping surface formed by the raised diamond areas provide an improved grip, e.g., when the handle is wet from perspiration.

Figure 8:
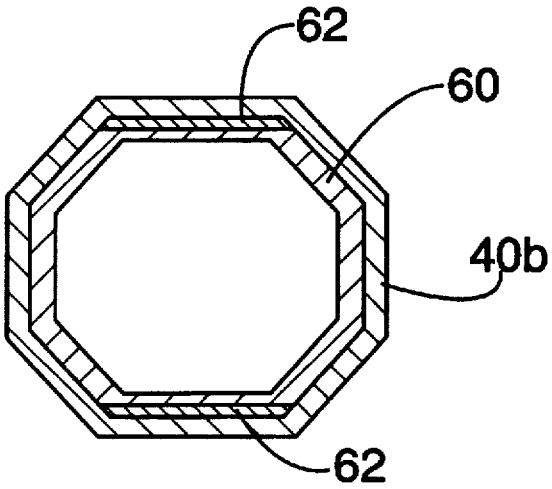
FIG. 8 is a cross-sectional view of a tennis racquet molded-in handle, containing an overgrip sleeve.

FIG. 8 shows an embodiment of a tennis racquet handle 60, in which the handle portion 60 is a molded-in handle of a monocoque construction. In molded-in handles, rather than sliding or foaming on a handle pallet over the shaft, for example as shown in FIG. 6, the shaft portion of the racquet in the handle region is molded directly into an octagonal outside handle shape. Such handle constructions are known in the art.

In the embodiment of FIG. 8, one or more of the outer surfaces are provided with a decorative design 62, which can be applied to the surface by paint or ink, or by adhering a decal containing decorative design, a hologram, by molding the outside surface of the handle 60 to have a 3-dimensional design, or by any other known means. An overgrip sleeve **40*b*, which may be the same as sleeve 40 or 40*a* (except that tennis racquet handles are generally larger in size than racquetball racquets), is disposed on the outside surface of the handle portion 60, which in this case means that the sleeve 40*b* is disposed directly on the racquet shaft 60**.

Where the overgrip sleeve **40*b* is mounted directly on the shaft, as in FIG. 8, such that it directly contacts the frame, it will not have a rubber-against-rubber contact as in FIGS. 2–7. Rather, the contact between the overgrip sleeve 40 and the outside surface of the handle 60 will be similar to that between the cushion handle pallet 22 and the shaft in FIG. 6. For such reasons, it is desirable to mount the sleeve 40 on the shaft handle portion 60 with a clear adhesive. Preferably, a solvent such as mineral spirits or naphtha is used to form adherence between the contact surfaces, and as described below such solvent also aids in sliding on the overgrip 40*b***.

The foregoing represents a preferred embodiment of the invention. Variations and modifications will be apparent to persons skilled in the art, without departing from the inventive concepts disclosed herein. All such modifications and variations are intended to be within the skill of the art, as defined in the following claims.

We claim:

1. A handle for a sports implement comprising:

a shaft having a portion intended to be gripped, said portion having an outer surface containing a decorative design; and an overgrip sleeve made of a thin, translucent, elastomeric material, which is sized to cover said outer surface and be in frictional contact therewith, such that said decorative design is visible.

2. A handle according to claim 1, wherein said outer surface is a light color.

3. A handle according to claim 2, wherein said outer surface is a pastel color.

4. A handle according to claim 1, wherein said sleeve grip has a wall thickness in the range of 1.2 to 2.0 mm.

5. A handle according to claim 4, wherein said grip sleeve interior, in an unstretched condition, is slightly smaller than said outer surface.

6. A handle according to claim 1, wherein said overgrip sleeve has a smooth inner surface and a contoured outer surface formed by a plurality of raised sections, to improve grip.

7. A handle according to claim 1, wherein said overgrip sleeve is transparent.

8. A handle according to claim 1, wherein said overgrip sleeve is slightly tinted.

9. A handle for a sports racquet comprising:

a handle having an outer surface sized to be gripped and containing a decorative design; and an overgrip sleeve made of a thin, translucent, elastomeric material, which is sized to cover said outer surface and be in frictional contact therewith, such that said decorative design is visible.

10. A handle according to claim 9, wherein said handle is formed of a pallet, and wherein said overgrip sleeve and pallet are made of materials having sufficient frictional affinity toward one another that said grip may be held on said pallet without any adhesive.

11. A handle according to claim 10, wherein said pallet outer surface includes a plurality of indentations forming said decorative pattern, and wherein said sleeve grip has an inner surface which is smooth and which contacts portions of the pallet outer surface other than said indentations.

12. A handle according to claim 11, wherein said pallet is formed of a cushion material.

13. A handle according to claim 12, wherein said pallet and sleeve grip are formed of thermoplastic rubber material.

14. A handle according to claim 9, wherein said outer surface is a light color.

15. A handle according to claim 14, wherein said pallet outer surface is a pastel color.

16. A handle according to claim 9, wherein said sleeve grip has a wall thickness in the range of 1.2 to 2.0 mm.

17. A handle according to claim 16, wherein said grip sleeve interior, in an unstretched condition, is slightly smaller than the pallet.

18. A handle according to claim 9, wherein said overgrip sleeve has a smooth inner surface and a contoured outer surface formed by a plurality of raised sections, to improve grip.

19. A handle according to claim 18, wherein said pallet has a butt end and a forward end, wherein said forward end has an outwardly projecting annular lip having an outwardly facing annular surface, wherein said overgrip sleeve has an end positioned against said lip, and wherein said overgrip sleeve has a thickness so as to be flush with the outwardly facing annular surface of the lip.

20. A handle according to claim 9, wherein said pallet outer surface includes regions containing indentations of varying shapes and arranged in varying configurations, forming said decorative pattern.

21. A handle according to claim 20, wherein at least one of said regions contains a logo having a raised design with an upper surface flush with the remainder of the outer surface of said pallet.

22. A handle according to claim 9, wherein said overgrip sleeve is transparent.

23. A handle according to claim 9, wherein said overgrip sleeve is slightly tinted.

24. A method of forming a sports implement handle, comprising the steps of:

providing a sports implement having a handle portion with an outer surface containing a decorative design;

providing an overgrip sleeve made of a thin, translucent, elastomeric material, which has an inner surface which is sized to cover said outer surface and be in frictional contact therewith; and applying a lubricating solvent to one of said surfaces, and then slipping said overgrip over said pallet such that said decorative design is visible, wherein said solvent is selected from solvents that will evaporate leaving both surfaces sticky.

* * * * *